US008089438B2

(12) United States Patent
Enjou

(10) Patent No.: US 8,089,438 B2
(45) Date of Patent: Jan. 3, 2012

(54) DATA LINE DRIVER CIRCUIT FOR DISPLAY PANEL AND METHOD OF TESTING THE SAME

(75) Inventor: Hiroyasu Enjou, Shiga (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 966 days.

(21) Appl. No.: 12/071,869

(22) Filed: Feb. 27, 2008

(65) Prior Publication Data

US 2008/0211835 A1 Sep. 4, 2008

(30) Foreign Application Priority Data

Mar. 1, 2007 (JP) ..... 2007-051359

(51) Int. Cl.
*G09G 3/36* (2006.01)

(52) U.S. Cl. ..... 345/87; 345/88

(58) Field of Classification Search ..... 345/87–104
See application file for complete search history.

(56) References Cited

U.S. PATENT DOCUMENTS

| | | | | |
|---|---|---|---|---|
| 7,227,542 | B2 * | 6/2007 | Koyama | 345/204 |
| 7,623,125 | B2 * | 11/2009 | Harada | 345/211 |
| 2003/0052851 | A1 * | 3/2003 | Yano et al. | 345/89 |
| 2004/0113879 | A1 * | 6/2004 | Sekiguchi et al. | 345/94 |
| 2004/0189564 | A1 * | 9/2004 | Makuuchi et al. | 345/87 |
| 2005/0024315 | A1 * | 2/2005 | Yamagata et al. | 345/98 |
| 2006/0061534 | A1 * | 3/2006 | Lee | 345/92 |
| 2006/0238473 | A1 * | 10/2006 | Hashimoto | 345/89 |
| 2006/0284646 | A1 * | 12/2006 | Shimizume et al. | 324/770 |

FOREIGN PATENT DOCUMENTS

| | | |
|---|---|---|
| JP | 11-264855 | 9/1999 |
| JP | 2001-255857 A | 9/2001 |
| JP | 2006-178029 A | 7/2006 |

OTHER PUBLICATIONS

Notification of First Office Action dated Aug. 9, 2011(with an English translation).

* cited by examiner

*Primary Examiner* — Alexander Eisen
*Assistant Examiner* — Nelson Lam
(74) *Attorney, Agent, or Firm* — McGinn IP Law Group, PLLC

(57) ABSTRACT

A data line driver circuit includes a D/A converter circuit including a first gradation voltage selecting circuit controlling transistors of a first group to select a gradation voltage of a first polarity based on a first display data. A second gradation voltage selecting circuit controls transistors of a second group to select a gradation voltage of a second polarity based on second display data. A first gradation voltage signal line transfers the first polarity gradation voltage and a second gradation voltage signal line transfers the second polarity gradation voltage. A test switching circuit operates in response to a test signal to form a short-circuit between the first and second gradation voltage signal lines, to allow a leakage current to be measured between a drain and a source in each of at least one transistor of the first group and at least one transistor of the second group.

17 Claims, 12 Drawing Sheets

DATA LINE DRIVER CIRCUIT FOR DISPLAY PANEL AND METHOD OF TESTING THE SAME

BACKGROUND OF THE INVENTION

1. Field of the Invention

The present invention relates to a data line driver circuit of a display panel, and a method of testing the same. This Patent application is based on Japanese Patent Application No. 2007-051359. The disclosure thereof is incorporated herein by reference.

2. Description of Related Art

A liquid crystal display apparatus will be described below with reference to FIG. 1. The liquid crystal display apparatus 100 is used as a display apparatus such as a mobile phone, a mobile terminal equipment, a note type of personal computer, a desktop type of personal computer and a television. As shown in FIG. 1, the liquid crystal display apparatus 100 contains a liquid crystal display panel 101, a data line driver circuit 102, a scanning line drive circuit 103, a power source 104 and a control circuit 105. The liquid crystal display panel 101 includes data lines 106 arranged to extend in a longitudinal direction, and scanning lines 107 arranged to extend in a lateral direction. Each of pixels includes a TFT (Thin Film Transistor) 108, a pixel capacitor 109 and a liquid crystal element 110. The gate terminal of the TFT 108 is connected to the scanning line 107, and the source (drain) electrode thereof is connected to the data line 106, respectively. Also, each of the pixel capacitor 109 and the liquid crystal element 110 is connected to the drain (source) electrode of the TFT 108. In the pixel capacitor 109 and the liquid crystal element 110, a terminal 111 that is not connected to the TFT 108 is connected to a common electrode (not shown). The data line driver circuit 102 outputs an image signal having a voltage determined based on a display data to drive the data line 106. The scanning line drive circuit 103 outputs a selection/non-selection voltage of the TFT 108 to drive the scanning line 107. The control circuit 105 controls the drive timings of the scanning line drive circuit 103 and the data line driver circuit 102. The power source 104 generates a signal voltage outputted from the data line driver circuit 102 and the power supply voltage used to generate the selection/non-selection voltage outputted from the scanning line drive circuit 103, and supplies to the respective driving circuits 102 and 103.

In this type of the liquid crystal display apparatus, a field inversion, a line inversion, a column inversion and a dot inversion are known as a method of alternately driving (or inversely driving) the display panel. The field inversion method is a method of setting the entire screen of the display panel to a same polarity and inverting it for each frame. The line inversion method is a method of setting to an opposite polarity for each column (scanning line) and inverting. The column inversion method is a method of setting to an opposite polarity for each row (data line) and inverting. The dot inversion method is a method of combining the line inversion and the column inversion and inverting in a checker-wise pattern. Among those methods, usually, the column inversion and the dot inversion are alternately driven by a common constant driving method. The common constant driving method is a driving method of keeping the voltage of a common electrode of a pixel constant and inverting the polarity of only the image signal from the data line driver circuit. Also, in case of the column inversion and the dot inversion, the data line driver circuit has a function of applying two kinds of image signals whose polarities are different to the plurality of data lines at the same time. The polarities of the image signal are defined as a positive polarity and a negative polarity with respect to a predetermined reference voltage (hereinafter, referred to as a "common level"). The common level is usually set close to a voltage equal to ½ of a high power supply voltage VDD of the data line driver circuit. It should be noted that the voltage of the common electrode is set to a voltage different from the common level for a field through correction for a display panel.

FIG. 2 is a block diagram showing the data line driver circuit used in the dot inversion method. The data line driver circuit in FIG. 2 includes a shift register circuit 112, a data register circuit 113, a data latch circuit 114, a level shifter circuit 115, a D/A (digital/analog) converter circuit 116 and an output circuit 117. The data line driver circuit shown in FIG. 2 is of a type that 2-system circuits are provided to alternately output positive and negative voltages. That is, in accordance with a polarity inversion signal, the positive and negative voltages with respect to the common level are alternately outputted in odd-numbered outputs and even-numbered outputs, to alternately drive the liquid crystal display panel while a relation between the positive and negative amplitudes is kept. In FIG. 2, the data register circuit 113 latches the display data (Dm, Dm-1, . . . , Dk, . . . , D2 and D1) of m (natural number) bits in parallel in response to the output from the shift register circuit 112. The data latch circuit 114 collectively latches the m-bit display data from the data register circuit 113 in response to a data latch signal. The data line driver circuit of the type shown in FIG. 2 generates a 2m-bit double-bit display data (Dm, DmB, Dm-1, Dm-1B, . . . , Dk, DkB, . . . , D2, D2B, D1 and D1B) from the latched m-bit display data (Dm, Dm-1, . . . , Dk, . . . , D2 and D1). Here, when Dk="H", DkB="L", and when Dk="L", DkB="H". Thus, as an information amount, there are still the m bits (K=1, 2, . . . , m). For the 2m-bit double-bit display data, the level shifter circuit 115 boosts up a voltage value. The D/A converter circuit 116 selects a desirable gradation voltage from $2^m$ gradation voltages in accordance with the 2m-bit double-bit display data. In the output circuit 117, the selected gradation voltage is amplified by an operational amplifier and outputted. In FIG. 2, 2n m-bit display data are supplied to the data line driver circuit, and 2n image signals S2*n*, S2*n*−1, S2*n*−2, . . . , S2 and S1 are outputted. In the type of the positive and negative 2-system circuits, there are the even-numbered display data and output image signals.

FIG. 3 is a block diagram showing the D/A converter circuit 116. The gradation voltage supplied from the power source 104 is converted to a gradation voltage in which the non-linearity of the transmittance of the liquid crystal element 110 is corrected by a γ correction resistor section 118. In FIG. 3, the $2^m$ positive gradation voltages and the $2^m$ negative gradation voltages are generated. Any one of the generated positive gradation voltages is selected by a positive gradation voltage selecting circuit (PchDAC) 119 for receiving the 2m-bit double-bit display data. Also, any one of the generated negative gradation voltages is selected by a negative gradation voltage selecting circuit (NchDAC) 120 for receiving the 2m-bit double-bit display data. The selected gradation voltage is outputted from the output circuit 117 through a switch 121 and operational amplifiers 122 and 123. When the switch 121 is in a straight state, the positive gradation voltages appear in the odd-numbered outputs S2*n*−1, S2*n*−3, S2*n*−5, . . . , S1, and the negative gradation voltages appear in the even-numbered outputs S2*n*, S2*n*−2, S2*n*−4, . . . , S2. Also, when the switch 121 is in a cross state, the negative gradation voltages appear in the odd-numbered outputs S2*n*−1, S2*n*−3, S2*n*−5, . . . , S1, and the positive gradation voltages appear in the even-numbered outputs S2*n*, S2*n*−2, S2*n*−4, . . . , S2. The gradation voltage is selected for each scanning line 107 and outputted as the image signal to the data line 106. When the scanning lines 107 are driven for one cycle, one frame (one screen) is displayed.

When a characteristic test of the data line driver circuit is carried out, there is a problem in leakage current in the gradation voltage selecting circuit whose circuit scale is large. As for the characteristic test of the gradation voltage selecting circuit, Japanese Patent Application Publication (JP-A-Heisei 11-264855) is known. This conventional example contains a resistor ladder in which a predetermined number of resistors are connected in series, a correction power supply voltage is supplied to at least one of connection nodes between the resistors, to generate the gradation voltages in all of the connection nodes. Also, this contains an ROM decoder for supplying a data and selecting one of the gradation voltages from the ladder resistor. Also, this conventional example contains a test circuit for measuring leakage current from a ROM decoder. Moreover, this conventional example has a short-circuit circuit for electrically short-circuiting a predetermined number of resistors, when the test circuit measures the leakage current.

In the above conventional example, the switch is provided between the γ correction resistor section and the gradation voltage selecting circuit, and the switch is used to separate the γ correction resistor section and the test of the gradation voltage selecting circuit is carried out. However, although the test can measure the leakage current between the gate and the source of a transistor in the gradation voltage selecting circuit, the test cannot measure the leakage current between the drain and the source.

SUMMARY

In an aspect of the present invention, a data line driver circuit for a display panel includes a digital-to-analog (D/A) converter circuit configured to convert two display data to be supplied into gradation voltages of first and second polarities. The D/A converter circuit includes a first gradation voltage selecting circuit configured to control transistors of a first group to select one of gradation voltages of the first polarity based on a first display data of the two display data; a second gradation voltage selecting circuit configured to control transistors of a second group to select one of gradation voltages of the second polarity based on a second display data of the two display data; a first gradation voltage signal line configured to transfer the first polarity gradation voltage selected by the first gradation voltage selecting circuit; a second gradation voltage signal line configured to transfer the second polarity gradation voltage selected by the second gradation voltage selecting circuit; and a test switching circuit configured to operate in response to a test signal. The test switching circuit forms a short-circuit between the first and second gradation voltage signal lines in response to the test signal, to allow a leakage current to be measured between a drain and a source in each of one or more of the transistors of the first group and one or more of the transistors of the second group.

In another aspect of the present invention, a test method for a data line driver circuit for a display panel is provided. The test method includes providing a digital-to-analog (D/A) converter circuit configured to convert two display data to be supplied into gradation voltages of first and second polarities, wherein the D/A converter circuit comprises a first gradation voltage selecting circuit configured to select one of gradation voltages of the first polarity based on a first display data; and a second gradation voltage selecting circuit configured to select one of gradation voltages of the second polarity based on a second display data; supplying a test voltage of the first polarity to the first gradation voltage selecting circuit and a test voltage of the second polarity to the second gradation voltage selecting circuit; and measuring a leakage current between an input and an output in one of the first and second gradation voltage selecting circuits by using the other of the first and second gradation voltage selecting circuits in response to a test signal.

In still another aspect of the present invention, a display apparatus includes a display panel; a data line driver circuit comprising a digital-to-analog (D/A) converter circuit configured to convert two display data to be supplied into gradation voltages of first and second polarities. The D/A converter circuit includes a first gradation voltage selecting circuit configured to control transistors of a first group to select one of gradation voltages of the first polarity based on a first display data of the two display data; a second gradation voltage selecting circuit configured to control transistors of a second group to select one of gradation voltages of the second polarity based on a second display data of the two display data; a first gradation voltage signal line configured to transfer the first polarity gradation voltage selected by the first gradation voltage selecting circuit; a second gradation voltage signal line configured to transfer the second polarity gradation voltage selected by the second gradation voltage selecting circuit; and a test switching circuit configured to operate in response to a test signal. The test switching circuit forms a short-circuit between the first and second gradation voltage signal lines in response to the test signal, to allow a leakage current to be measured between a drain and a source in each of one or more of the transistors of the first group and one or more of the transistors of the second group.

According to the present invention, it is possible to measure the leakage current between the drain and the source of the transistor in the gradation voltage selecting circuit.

BRIEF DESCRIPTION OF THE DRAWINGS

The above and other objects, advantages and features of the present invention will be more apparent from the following description of certain embodiments taken in conjunction with the accompanying drawings, in which.

DESCRIPTION OF THE PREFERRED EMBODIMENTS

Hereinafter, a data line driver circuit according to the embodiments of the present invention will be described in detail with reference to the attached drawings.

First Embodiment

Figure 4:
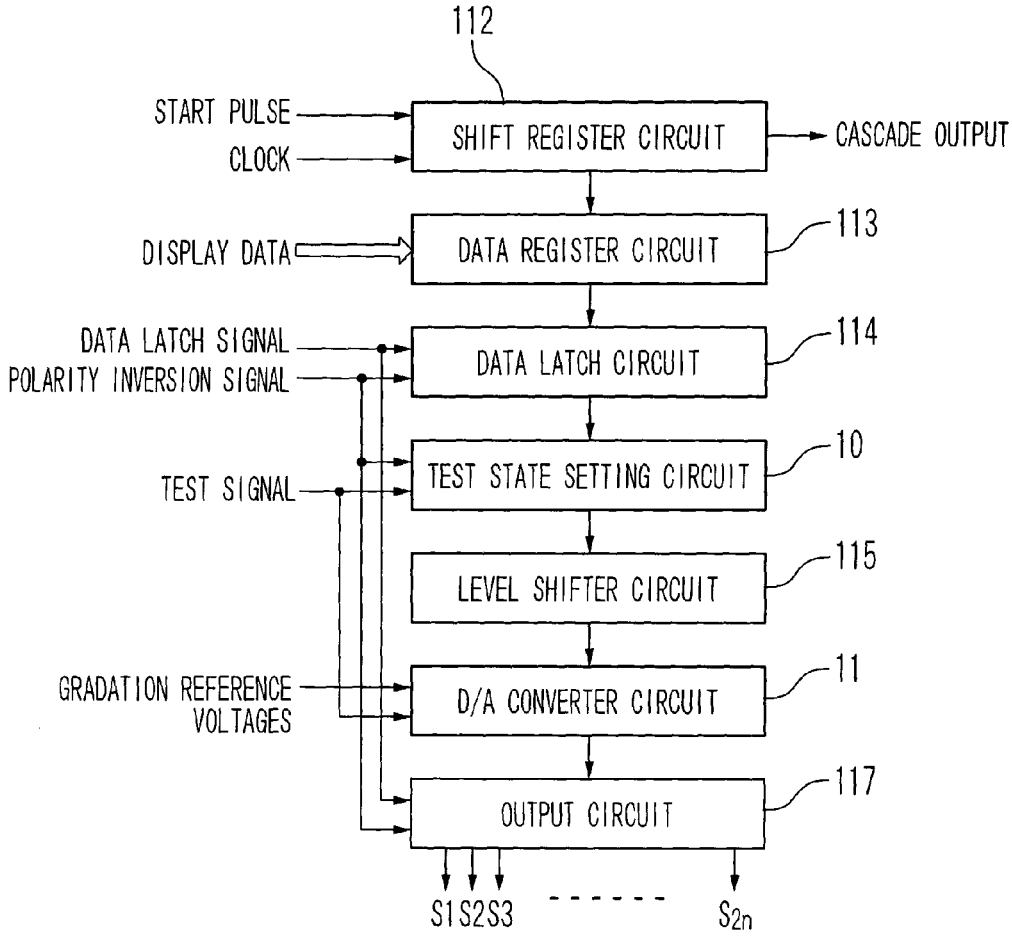
FIG. 4 shows a block diagram showing the configuration of a data line driver circuit according to a first embodiment of the present invention.

FIG. 4 shows a block diagram showing the configuration of the data line driver circuit according to a first embodiment of the present invention. In FIG. 4, the data line driver circuit is used in a dot inversion method, and is of a type that the 2-system circuit groups are provided in order to alternately output the positive and negative outputs. As shown in FIG. 4, the data line driver circuit according to the first embodiment of the present invention contains a shift register circuit 112, a data register circuit 113, a data latch circuit 114, a test state setting circuit 10, a level shifter circuit 115, a D/A (digital/analog) converter circuit 11 and an output circuit 117. The test state setting circuit 10 generates a testing double-bit display data when a test signal is turned on. Also, the D/A converter circuit 11 is switched from a normal operation state to a test state, when the test signal is turned on. Hereinafter, for the sake of the easy understanding, the data line driver circuit for receiving 2n m-bit display data and outputting 2n image signals is exemplified in case of m=2 and n=1.

Figure 5:
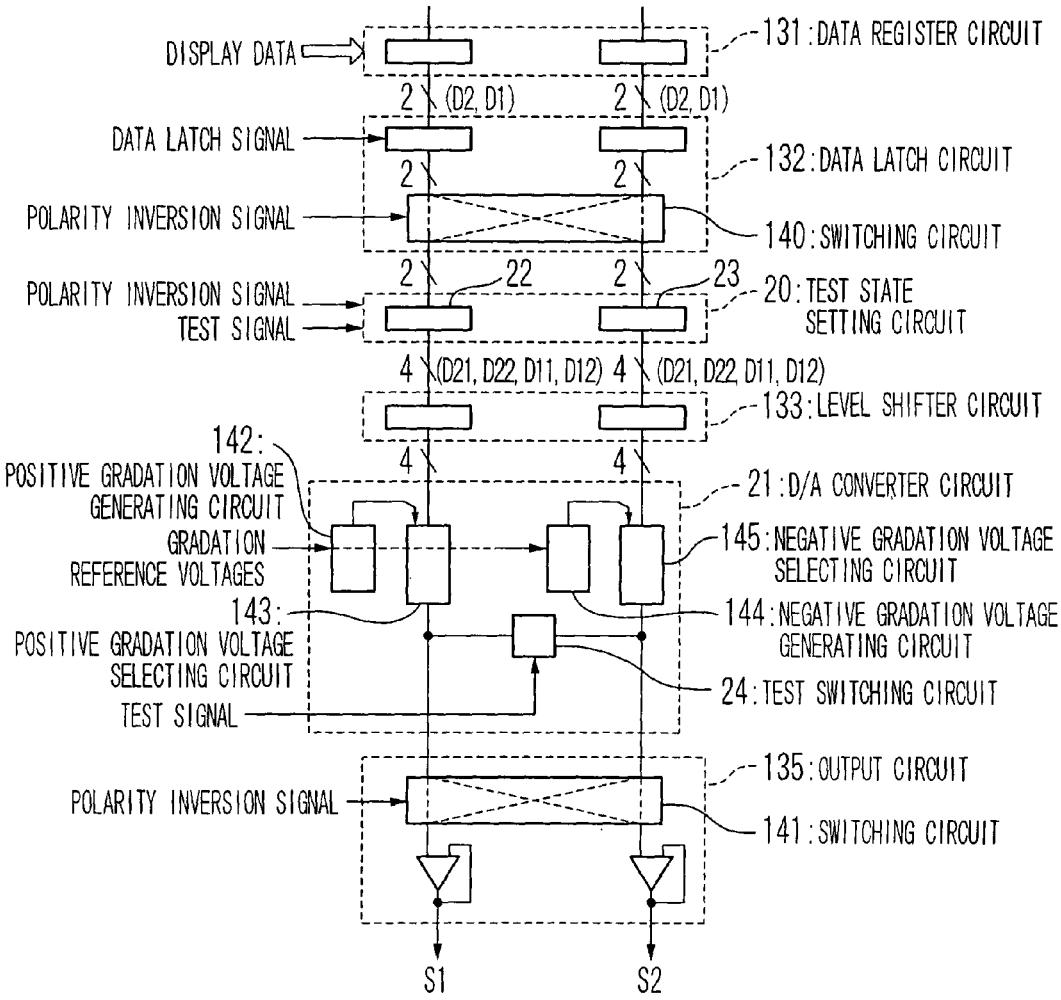
FIG. 5 is a block diagram showing the configuration of the data line driver circuit in the first embodiment in case of m=2 and n=1.

FIG. 5 is a block diagram showing the configuration of the data line driver circuit in the first embodiment in case of m=2 and n=1. In FIG. 5, the data line driver circuit includes a data register 131, a data latch circuit 132, a test state setting circuit 20, a level shifter circuit 133, a D/A converter circuit 21 and an output circuit 135. The data register 131 latches 2-bit display data (D2, D1) in parallel based on outputs from two stages of a shift register circuit (not shown). The data latch circuit 132 collectively latches the 2-bit display data from the data register 131 in response to a data latching signal. The test state setting circuit 20 contains a positive test double-bit display data generating circuit 22 and a negative test double-bit display data generating circuit 23. The respective generating circuits 22 and 23 generate 4-bit double-bit display data (D2, D2B, D1 and D1B) from the latched 2-bit display data (D2, D1) when the test signal is turned off. Here, when Dk="H", DkB="L", and when Dk="L", DkB="H" (K=1, 2). Also, the respective generating circuits 22 and 23 generate 4-bit test double-bit display data (D21, D22, D11 and D12) from the latched 2-bit display data (D2, D1), when the test signal is turned on. For the 4-bit double-bit display data, the level shifter circuit 133 boosts up the voltage of the display data. The D/A converter circuit 21 selects a desirable gradation voltage from the four gradation voltages in accordance with the 4-bit double-bit display data. In the output circuit 135, the selected gradation voltage is amplified by an operational amplifier and outputted.

In FIG. 5, two 2-bit display data are supplied to the data line driver circuit, and two image signals S2 and S1 are outputted. In FIG. 5, a first switch and a second switch in a switching circuit 140 are controlled by a polarity inversion signal. When the polarity inversion signal is turned off, the first switch and the second switch are straight. At this time, the positive gradation voltage appears in the image signal S1 corresponding to the first display data that is supplied to the circuit group on the left side of FIG. 5, and the negative gradation voltage appears in the image signal S2 corresponding to the second display data that is supplied to the circuit group on the right side. On the other hand, when the polarity inversion signal is turned on, the first switch and the second switch are in a cross state. At this time, the negative gradation voltage appears in the image signal S1 corresponding to the first display data that is supplied to the circuit group on the left side of FIG. 5, and the positive gradation voltage appears in the image signal S2 corresponding to the second display data that is supplied to the circuit group on the right side.

In FIG. 5, the D/A converter circuit 21 contains a positive gradation voltage generating circuit 142, a positive gradation voltage selecting circuit 143, a negative gradation voltage generating circuit 144, a negative gradation voltage selecting circuit 145 and a test switching circuit 24. The positive gradation voltage generating circuit 142 generates positive 4-level gradation voltages from gradation reference voltages. The positive gradation voltage selecting circuit 143 selects any one of the positive gradation voltages in accordance with the 4-bit double-bit display data. The negative gradation voltage generating circuit 144 generates negative 4-level gradation voltages from the gradation reference voltages. The negative gradation voltage selecting circuit 145 selects any one of the negative gradation voltages in accordance with the 4-bit double-bit display data. The test switching circuit 24 is set to an open state when the test signal is turned off, and the test switching circuit 24 is in the close state when the test signal is turned on.

Figure 6:
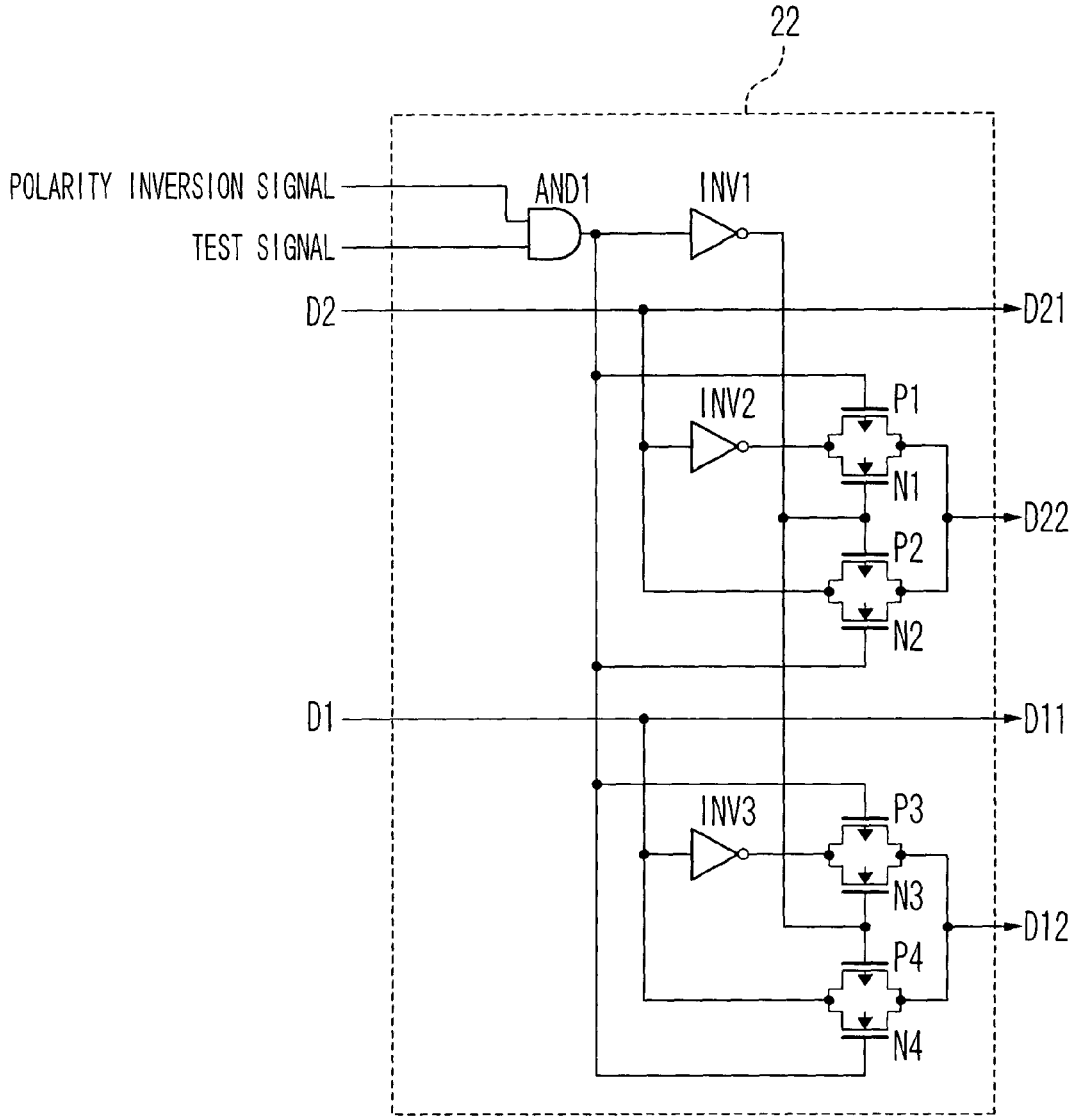
FIG. 6 is a circuit diagram showing the configuration of a positive test double-bit display data generating circuit.

The test state setting circuit 20 will be described below with reference to FIGS. 6 and 7. FIG. 6 is a circuit diagram showing the configuration of the positive test double-bit display data generating circuit 22. At first, the operation of the positive test double-bit display data generating circuit 22 when the test signal is turned off will be described. When the test signal is turned off, an AND circuit AND1 is turned off, and the output of an inverter INV1 becomes high. As a result, transistors P1 and N1 are turned on, and transistors P2 and N2 are turned off. Thus, an output node D22 is set to the inversion output of the input data D2 through an inverter INV2 and the transistors P1 and N1. That is, D21=D2 and D22=D2B. Also, when the test signal is turned off, the AND circuit AND1 is turned off, and the output of the inverter INV1 becomes high. As a result, transistors P3 and N3 are turned on, and transistors P4 and N4 are turned off. Thus, an output node D12 is set to the inversion output of input data D1 through an inverter INV3 and the transistors P3 and N3. That is, D11=D1 and D12=D1B.

Next, the operation of the positive test double-bit display data generating circuit 22 when the test signal is turned on will be described. When the polarity inversion signal is turned off, the AND circuit AND1 is turned off. Thus, the output nodes D21, D22, D11 and D12 are set to the same states as states when the test signal is turned off. That is, D21=D2, D22=D2B, D11=D1 and D12=D1B. When the polarity inversion signal is turned on, the AND circuit AND1 is turned on, and the output of the inverter INV1 becomes low. As a result, the transistors P1 and N1 are turned off, and the transistors P2 and N2 are turned on. Thus, the input data D2 appears in the output node D22 through the transistors P2 and N2. That is, D21=D22=D2. Also, when the polarity inversion signal is turned on, the AND circuit AND1 is turned on, and the output of the inverter INV1 becomes low. As a result, the transistors P3 and N3 are turned off, and the transistors P4 and N4 are turned on. Thus, the input data D1 appears in the output node D12 through the transistors P4 and N4. That is, D11=D12=D1. As mentioned above, the positive test double-bit display data generating circuit 22 outputs D21=D22=D2 and D11=D12=D1 when the test signal and the polarity inversion signal are both turned on, and outputs D21=D2, D22=D2B, D11=D1 and D12=D1B when any one of them is turned off.

Figure 7:
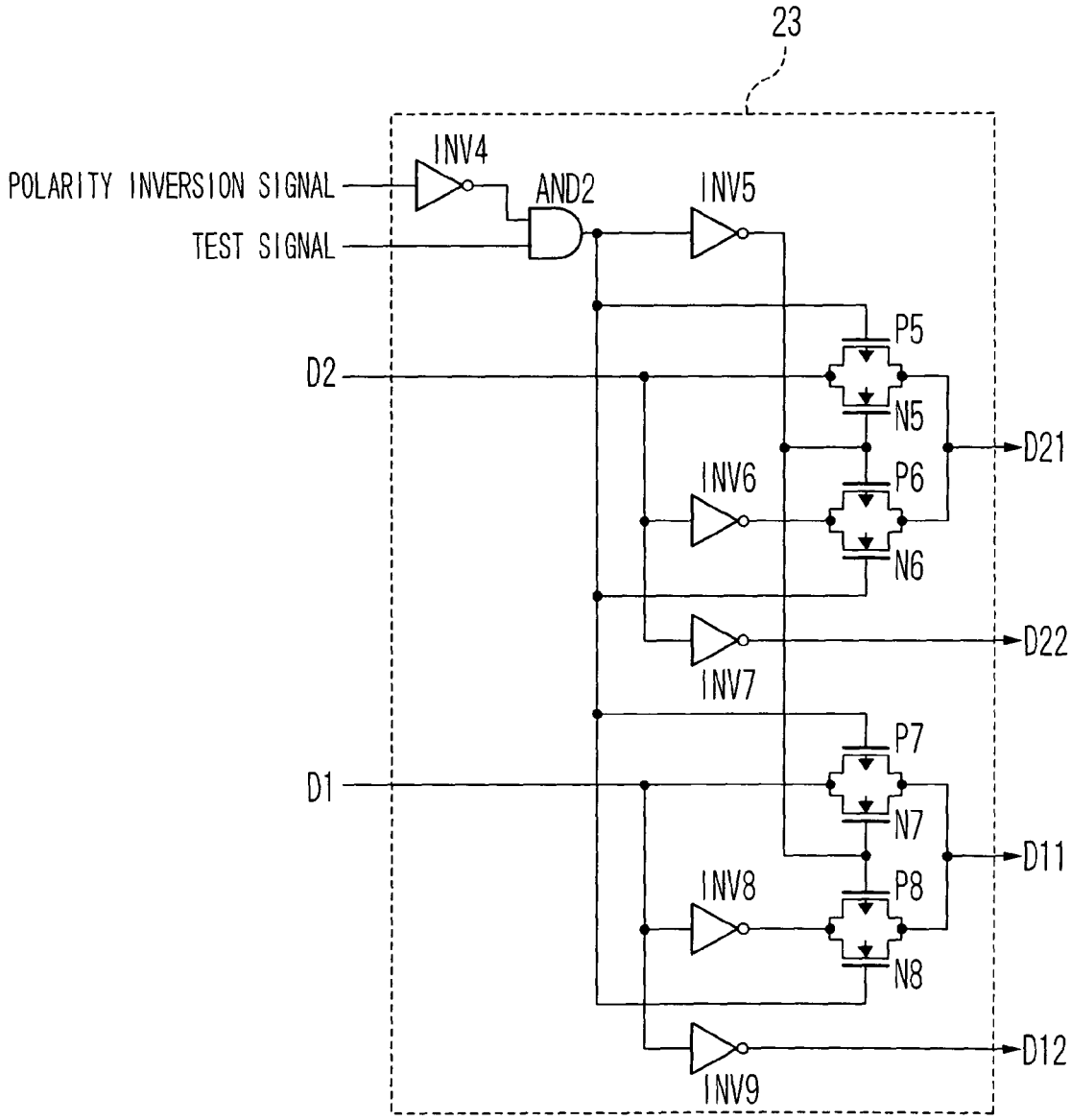
FIG. 7 is a circuit diagram showing the configuration of a negative test double-bit display data generating circuit.

FIG. 7 is a circuit diagram showing the configuration of the negative test double-bit display data generating circuit 22. At first, the operation of the negative test double-bit display data generating circuit 23 when the test signal is turned off will be described. When the test signal is turned off, an AND circuit AND2 is turned off, and the output of an inverter INV5 becomes high. As a result, transistors P5 and N5 are turned on, and transistors P6 and N6 are turned off. Thus, the output node D21 is set to the input data D2 through the transistors P5 and N5. Simultaneously, the output node D22 is set to the data D2B through an inverter INV7. That is, D21=D2 and D22=D2B. Also, when the test signal is turned off, the AND circuit AND2 is turned off, and the output of the inverter INV5 becomes high. As a result, transistors P7 and N7 are turned on, and transistors P8 and N8 are turned off. Thus, the output node D11 is set to the input data D1 through the transistors P7 and N7. Simultaneously, the output node D12 is set to the data D1B through an inverter INV9. That is, D11=D1 and D12=D1B.

Next, the operation of the negative test double-bit display data generating circuit 23 when the test signal is turned on will be described. When the polarity inversion signal is turned on, the output of an inverter INV4 is low, and the output of the AND circuit AND2 is low. Thus, the output nodes D21, D22, D11 and D12 are set to the same state as the states when the test signal is turned off. That is, D21=D2, D22=D2B, D11=D1 and D12=D1B. When the polarity inversion signal is turned off, the output of the inverter INV4 is high, and the output of the AND circuit AND2 is high. As a result, the output of the inverter INV5 becomes low, the transistors P5 and N5 are turned off, and the transistors P6 and N6 are turned on. Thus, the data D2B appears in the output node D21 through an inverter INV6 and the transistors P6 and N6. That is, D21=D22=D2B. Also, when the polarity inversion signal is turned off, the output of the inverter INV4 becomes high, and the AND circuit AND2 becomes high. As a result, the output of the inverter INV5 becomes low, and the transistors P7 and N7 are turned off, and the transistors P8 and N8 are turned on. Thus, the data D1B appears in the output node D12 through an inverter INV8 and the transistors P8 and N8. Simultaneously, the output node D12 is set to the data D1B through the inverter INV9. That is, D11=D12=D1B. As mentioned above, the negative test double-bit display data generating circuit 23 outputs D21=D22=D2B and D11=D12=D1B when the test signal is turned on and the polarity inversion signal is turned off, and outputs D21=D2, D22=D2B, D11=D1 and D12=D1B when the test signal is turned off or the polarity inversion signal is turned on.

Figure 8:
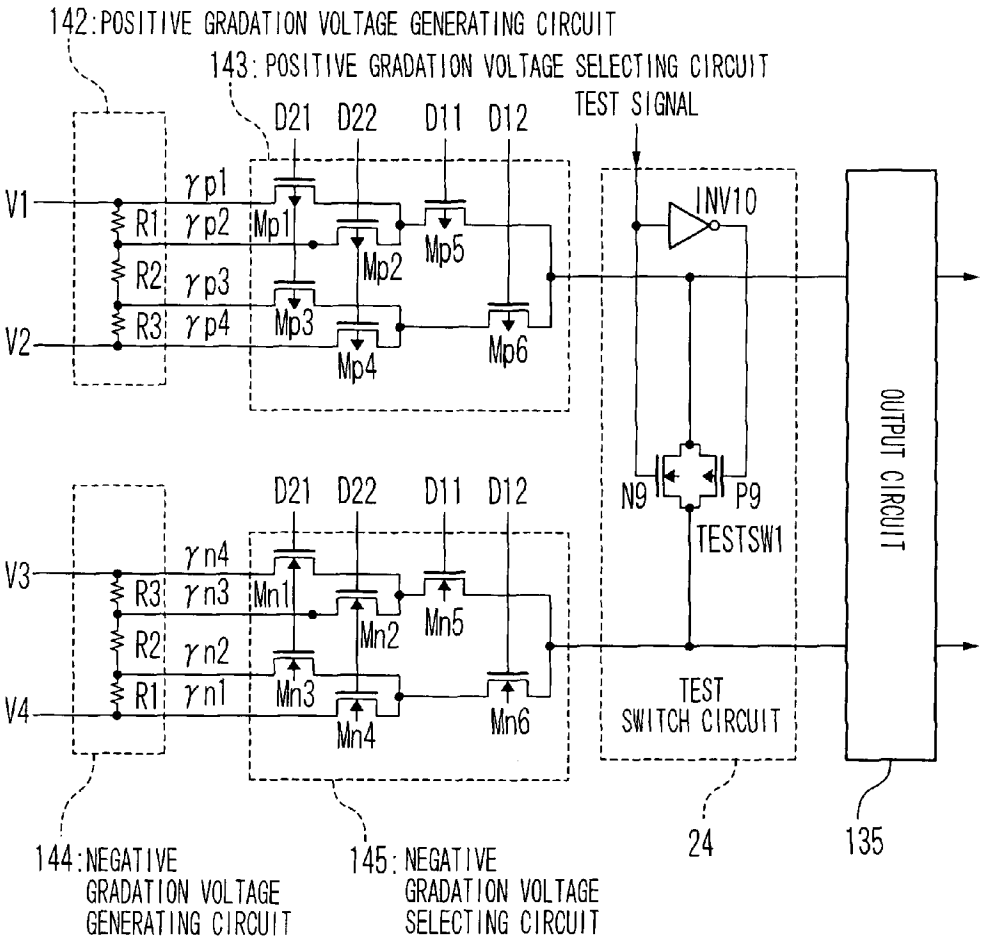
FIG. 8 is a view explaining a detail of a D/A converter circuit.

Subsequently, the D/A converter circuit 21 will be described with reference to FIG. 8. In FIG. 8, the D/A converter circuit 21 contains the positive gradation voltage generating circuit 142, the positive gradation voltage selecting circuit 143, the negative gradation voltage generating circuit 144, the negative gradation voltage selecting circuit 145 and the test switching circuit 24. The positive gradation voltage generating circuit 142 has ladder resistors R1, R2 and R3. When the test signal is in the off state, the positive gradation voltage generating circuit 142 receives gradation reference voltages V1 and V2 (V1>V2) at terminals V1 and V2 (represented by using the same symbols as the voltages) and supplies positive gradation voltages γp1 to γp4 of 4 ($=2^2$) gradation levels. Also, when the test signal is in the on state, the positive gradation voltage generating circuit 142 receives a test voltage VTESTVP at either of the terminals V1 and V2 and supplies the test voltage VTESTVP from the output ends of the positive gradation voltages γp1 to γp4 of the 4 ($=2^2$) gradation levels.

The negative gradation voltage generating circuit 144 has ladder resistors R3, R2 and R1. When the test signal is in the off state, the negative gradation voltage generating circuit 144 receives gradation reference voltages V3 and V4 (V1>V2>V3>V4) at terminals V3 and V4 (represented by using the same symbols as the voltages) and supplies negative gradation voltages of 4 ($=2^2$) gradation levels. Also, when the test signal is in the on state, the negative gradation voltage generating circuit 144 receives a test voltage VTESTVN (VTESTVP>VTESTVN) at either or both of the terminals V3 and V4 and supplies the test voltage VTESTVN from the output ends of the negative gradation voltages γn1 to γn4 of 4 ($=2^2$) gradation levels.

The positive gradation voltage selecting circuit 143 has transistors Mp1 to Mp6. When the test signal is in the off state, the positive gradation voltage selecting circuit 143 selects any one of the positive gradation voltages in accordance with the positive double-bit display data composed of 4 (=2×2) bits. The case where the test signal is turned on will be described later.

The negative gradation voltage selecting circuit 145 has transistors Mp1 to Mp6. When the test signal is in the off state, the negative gradation voltage selecting circuit 145 selects any one of the negative gradation voltages in accordance with the negative double-bit display data composed of 4 (=2×2) bits. The case when the test signal is turned on will be described later.

The test switching circuit 24 electrically short-circuits the gradation voltage signal line for transferring the positive gradation voltage selected by the positive gradation voltage selecting circuit 143 and the gradation voltage signal line for transferring the negative gradation voltage selected by the negative gradation voltage selecting circuit 145, when the test signal is in the on sate.

The operation of the D/A converter circuit 21 when the test signal is in the off state will be described. At this time, in the test switching circuit 24, since the output of an inverter INV10 becomes high, a test switch TESTSW1 composed of transistors P9 and N9 is turned off. Thus, the selected positive gradation voltage and the selected negative gradation voltage are transferred to the output circuit 135 from the D/A converter circuit 21. It should be noted that when the test signal is turned off, the test state setting circuit 20 outputs D21=D2, D22=D2B, D11=D1 and D12=D1B, as the positive double-bit display data and the negative double-bit display data.

The case when the polarity inversion signal is in the off state will be described. At this time, the double-bit display data generated in accordance with a first display data appears as the positive double-bit display data, and the double-bit display data generated in accordance with a second display data appears as the negative double-bit display data.

In the positive gradation voltage selecting circuit 143, when the data D2 of the first display data is "H", the transistors Mp2 and Mp4 are turned on, and the transistors Mp1 and Mp3 are turned off. Thus, the gradation voltages γp2 and γp4 are selected, and the gradation voltages γp1 and γp3 are not selected. When the data D1 of the first display data is "H", and the data D2 of the first display data is "H", the transistor Mp6 is turned on, and the transistor Mp5 is turned off. Thus, the gradation voltage γp4 is selected, and the gradation voltages γp1, γp2 and γp3 are not selected. When the data D2 of the first display data is "H", and the D1 of the first display data is "L", the transistor Mp5 is turned on, and the transistor Mp6 is turned off. Thus, the gradation voltage γp2 is selected, and the gradation voltages γp1, γp3 and γp4 are not selected. On the other hand, when the data D2 of the first display data is "L", the transistors Mp1 and Mp3 are turned on, and the transistors Mp2 and Mp4 are turned off. Thus, the gradation voltages γp1 and γp3 are selected, and the gradation voltages γp2 and γp4 are not selected. When the data D2 of the first display data is "L", and the data D1 of the first display data is "H", the transistor Mp6 is turned on, and the transistor Mp5 is turned off. Thus, the gradation voltage γp3 is selected, and the gradation voltages γp1, γp2 and γp4 are not selected. When the data D2 of the first display data is "L", and the data D1 of the first display data is "L", the transistor Mp5 is turned on, and the transistor Mp6 is turned off. Thus, the gradation voltage γp1 is selected, and the gradation voltages γp2, γp3 and γp4 are not selected. As mentioned above, the gradation voltage γp1 is selected at the time of the first display data (D2, D1)=(L, L), the gradation voltage γp2 is selected at the time of the first display data (D2, D1)=(H, L), the gradation voltage γp3 is selected at the time of the first display data (D2, D1)=(L, H), and the gradation voltage γp4 is selected at the time of the first display data (D2, D1)=(H, H).

In the negative gradation voltage selecting circuit 145, when the data D2 of the second display data is "H", the transistors Mn1 and Mn3 are turned on, and the transistors Mn2 and Mn4 are turned off. Thus, the gradation voltages γn2 and γn4 are selected, and the gradation voltages γn1 and γn3 are not selected. When the data D2 of the second display data is "H", and the data D1 of the second display data is "H", the transistor Mn5 is turned on, and the transistor Mn6 is turned off. Thus, the gradation voltage γn4 is selected, and the gradation voltages γn1, γn2 and γn3 are not selected. When the data D2 of the second display data is "H", and the data D1 of the second display data is "L", the transistor Mn6 is turned on, and the transistor Mn5 is turned off. Thus, the gradation voltage γn2 is selected, and the gradation voltages γn1, γn3 and γn4 are not selected. On the other hand, when the data D2 of the second display data is "L", the transistors Mn2 and Mn4 are turned on, and the transistors Mn1 and Mn3 are turned off. Thus, the gradation voltages γn1 and γn3 are selected, and the gradation voltages γn2 and γn4 are not selected. When the data D2 of the second display data is "L", and the data D1 of the second display data is "H", the transistor Mn5 is turned on, and the transistor Mn6 is turned off. Thus, the gradation voltage γn3 is selected, and the gradation voltages γn1, γn2 and γn4 are not selected. When the data D2 of the second display data is "L", and the data D1 of the second display data is "L", the transistor Mn6 is turned on, and the transistor Mn5 is turned off. Thus, the gradation voltage γn1 is selected, and the gradation voltages γn2, γn3 and γn4 are not selected. As mentioned above, the gradation voltage γn1 is selected at the time of the second display data (D2, D1)=(L, L), the gradation voltage γn2 is selected at the time of the second display data (D2, D1)=(H, L), the gradation voltage γn3 is selected at the time of the second display data (D2, D1)=(L, H), and the gradation voltage γn4 is selected at the time of the second display data (D2, D1)=(H, H).

The operation when the polarity inversion signal is turned on will be described. At this time, the double-bit display data generated in accordance with the second display data appears as the positive double-bit display data, and the double-bit display data generated in accordance with the first display data appears as the negative double-bit display data. In the positive gradation voltage selecting circuit 143, the gradation voltage γp1 is selected at the time of the second display data (D2, D1)=(L, L), the gradation voltage γp2 is selected at the time of the second display data (D2, D1)=(H, L), the gradation voltage γp3 is selected at the time of the second display data (D2, D1)=(L, H), and the gradation voltage γp4 is selected at the time of the second display data (D2, D1)=(H, H). Also, in the negative gradation voltage selecting circuit 145, the gradation voltage γn1 is selected at the time of the first display data (D2, D1)=(L, L), the gradation voltage γn2 is selected at the time of the first display data (D2, D1)=(H, L), the gradation voltage γn3 is selected at the time of the first display data (D2, D1)=(L, H), and the gradation voltage γn4 is selected at the time of the first display data (D2, D1)=(H, H).

The operation of the D/A converter circuit 21 when the test signal is in the on state will be described. A test voltage VTESTVP such as a power supply voltage VDD2 is applied to at least one of the terminals V1 and V2, and a test voltage VTESTVN such as a ground voltage is applied to at least one of the terminals V3 and V4. One of the test voltages VTESTVP and VTESTVN is supplied through a current meter. At this time, in the test switching circuit 24, since the output of the inverter INV10 becomes low, the test switch TESTSW1 composed of the transistors P9 and N9 is turned on. Thus, the gradation voltage signal line for transferring the positive gradation voltage selected by the positive gradation voltage selecting circuit 143 and the gradation voltage signal line for transferring the negative gradation voltage selected by the negative gradation voltage selecting circuit 145 are electrically short-circuited.

The operation when the polarity inversion signal is turned off will be described. At this time, the test state setting circuit 20 outputted D21=D2, D22=D2B, D11=D1 and D12=D1B as the positive test double-bit display data. On the other hand, the test state setting circuit 20 outputted D21=D22=D2B and D11=D12=D1B as the negative test double-bit display data. Also, the double-bit display data generated in accordance with the first display data appeared as the positive double-bit display data, and the double-bit display data generated in accordance with the second display data appeared as the negative double-bit display data. In this example, the test is carried out under the assumption of the first display data (D2, D1)=the second display data (D2, D1) at the time of the test.

The leakage current between the drain and the source in each of the transistors Mn1 to Mn4 is tested. The first display data (D2, D1)=the second display data (D2, D1)=(H, L) is supplied to the data line driver circuit. In the positive gradation voltage selecting circuit 143, (D21, D22, D11, D12)=(H, L, L, H) is supplied as the positive test double-bit display data. Thus, the transistors Mp2, Mp4 and Mp5 are turned on, and the transistors Mp1, Mp3 and Mp6 are turned off. As a result, a route through which the gradation voltage γp2 is outputted in the usual state is selected. Consequently, the test voltage VTESTVP is applied through this selected route and the test switching circuit 24 to the gradation voltage signal line for transferring the negative gradation voltage selected by the negative gradation voltage selecting circuit 145. In the negative gradation voltage selecting circuit 145, (D21, D22, D11, D12)=(L, L, H, H) is supplied as the negative test double-bit display data. Thus, the transistors Mn5 and Mn6 are turned on, and the transistors Mn1, Mn2, Mn3 and Mn4 are turned off. As a result, the test voltage VTESTVP through the transistors Mn5 and Mn6 and the test voltage VTESTVN through the negative gradation voltage generating circuit 144 are applied between the drain and the source in each of the transistors Mn1 to Mn4. By measuring the current values at this time, it is possible to test the leakage current between the drain and the source in each of the transistors Mn1 to Mn4.

The leakage current between the drain and the source in each of the transistors Mn5 and Mn6 is tested. The first display data (D2, D1)=the second display data (D2, D1)=(L, H) is supplied to the data line driver circuit. In the positive gradation voltage selecting circuit 143, (D21, D22, D11, D12)=(L, H, H, L) is supplied as the positive test double-bit display data. Thus, the transistors Mp1, Mp3 and Mp6 are turned on, and the transistors Mp2, Mp4 and Mp5 are turned off. As a result, a route through which the gradation voltage γp3 is outputted in the usual state is selected. Consequently, the test voltage VTESTVP is applied through this selected route and the test switching circuit 24 to the gradation voltage signal line for transferring the negative gradation voltage selected by the negative gradation voltage selecting circuit 145. In the negative gradation voltage selecting circuit 145, (D21, D22, D11, D12)=(H, H, L, L) is supplied as the negative test double-bit display data. Thus, the transistors Mn1, Mn2, Mn3 and Mn4 are turned on, and the transistors Mn5 and Mn6 are turned off. As a result, the test voltage VTESTVP and the test voltage VTESTVN through the negative gradation voltage generating circuit 144 and the transistors Mn1 to Mn4 are applied between the drain and the source in each of the transistors Mn5 and Mn6. By measuring the current values at this time, it is possible to test the leakage current between the drain and the source in each of the transistors Mn5 and Mn6.

The operation when the polarity inversion signal is turned on will be described. At this time, the test state setting circuit 20 outputted D21=D22=D2 and D11=D12=D1 as the positive test double-bit display data. On the other hand, the test state setting circuit 20 outputted D21=D2, D22=D2B, D11=D1 and D12=D1B as the negative test double-bit display data. Also, the double-bit display data generated in accordance with the second display data appeared as the positive double-bit display data, and the double-bit display data generated in accordance with the first display data appeared as the negative double-bit display data. Also, in this example, similarly to the operation when the polarity inversion signal is turned off, the test is carried out under the assumption of the first display data (D2, D1)=the second display data (D2, D1) at the time of the test.

The leakage current between the drain and the source in each of the transistors Mp1 to Mp4 is tested. The first display data (D2, D1)=the second display data (D2, D1)=(H, L) is supplied to the data line driver circuit. In the negative gradation voltage selecting circuit 145, (D21, D22, D11, D12)=(H, L, L, H) is supplied as the negative test double-bit display data. Thus, the transistors Mn1, Mn3 and Mn6 are turned on, and the transistors Mn2, Mn4 and Mn5 are turned off. As a result, a route through which the gradation voltage γn2 is outputted in the usual state is selected. Consequently, the test voltage VTESTVN is applied through this selected route and the test switching circuit 24 to the gradation voltage signal line for transferring the positive gradation voltage selected by the positive gradation voltage selecting circuit 143. In the positive gradation voltage selecting circuit 143, (D21, D22, D11, D12)=(H, H, L, L) is supplied as the positive test double-bit display data. Thus, the transistors Mp5 and Mp6 are turned on, and the transistors Mp1, Mp2, Mp3 and Mp4 are turned off. As a result, the test voltage VTESTVP through the positive gradation voltage generating circuit 142 and the test voltage VTESTVN through the transistors Mp5 and Mp6 are applied between the drain and the source in each of the transistors Mp1 to Mp4. By measuring the current values at this time, it is possible to test the leakage current between the drain and the source in each of the transistors Mp1 to Mp4.

The leakage current between the drain and the source in each of the transistors Mp5 and Mp6 is tested. The first display data (D2, D1)=the second display data (D2, D1)=(L, H) is supplied to the data line driver circuit. In the negative gradation voltage selecting circuit 145, (D21, D22, D11, D12)=(L, H, H, L) is supplied as the negative test double-bit display data. Thus, the transistors Mn2, Mn4 and Mn5 are turned on, and the transistors Mn1, Mn3 and Mn6 are turned off. As a result, a route through which the gradation voltage γn3 is outputted in the usual state is selected. Consequently, the test voltage VTESTVN is applied through this selected route and the test switching circuit 24 to the gradation voltage signal line for transferring the positive gradation voltage selected by the positive gradation voltage selecting circuit 143. In the positive gradation voltage selecting circuit 143, (D21, D22, D11, D12)=(L, L, H, H) is supplied as the positive test double-bit display data. Thus, the transistors Mp1, Mp2, Mp3 and Mp4 are turned on, and the transistors Mp5 and Mp6 are turned off. As a result, the test voltage VTESTVP through the positive gradation voltage generating circuit 142 and the transistors Mp1, Mp2, Mp3 and Mp4 and the test voltage VTESTVN are applied between the drain and the source in the transistors Mp5 and Mp6. By measuring the current values at this time, it is possible to test the leakage current between the drain and the source in each of the transistors Mp5 and Mp6.

Second Embodiment

Figure 9:
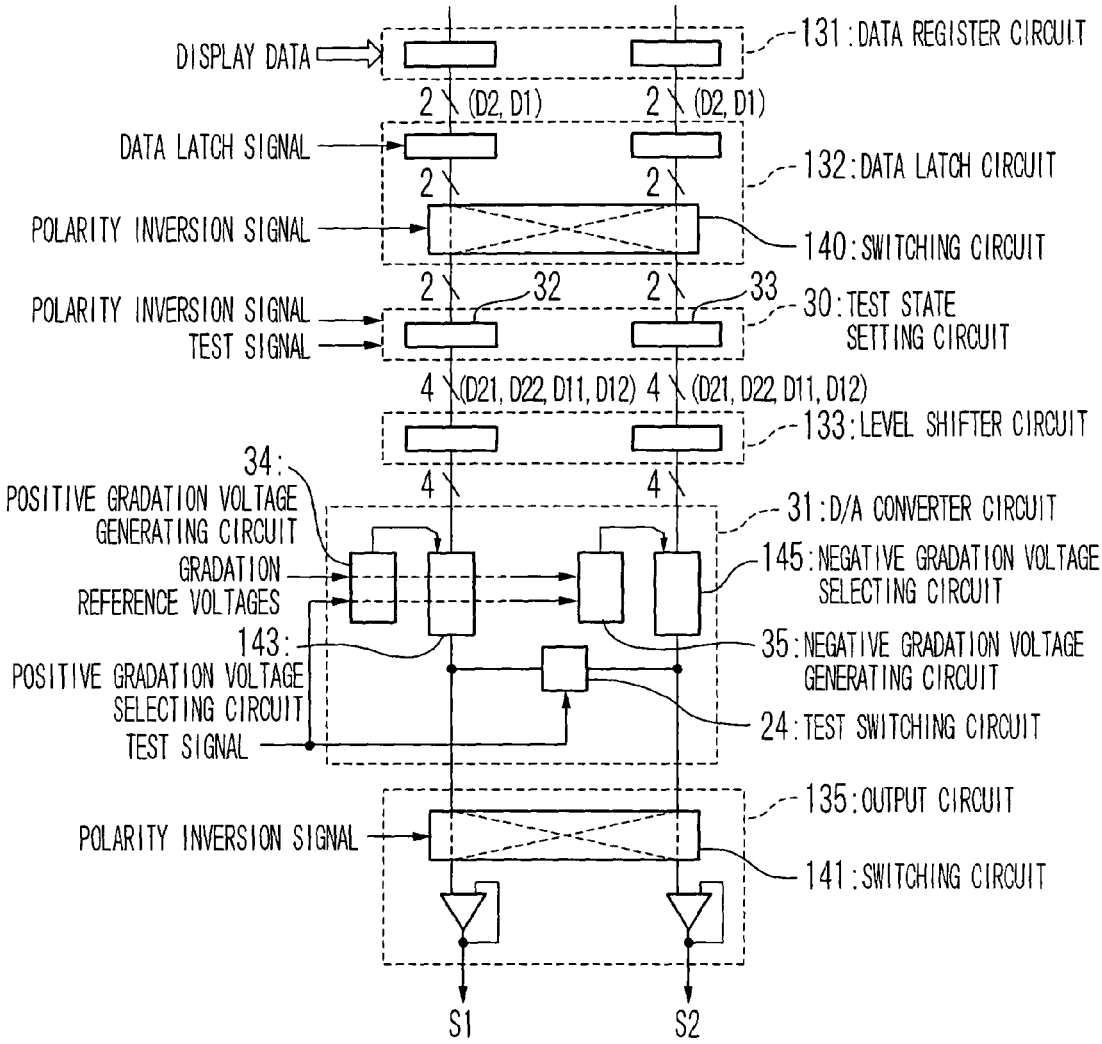
FIG. 9 is a block diagram showing the configuration of the data line driver circuit according to a second embodiment of the present invention in case of m=2 and n=1.

FIG. 9 is a block diagram showing the configuration of the data line driver circuit according to a second embodiment of the present invention in case of m=2 and n=1. In FIG. 9, the configuration of the data line driver circuit according to the second embodiment is similar to that of the first embodiment, and a test state setting circuit 30 is different from the test state setting circuit 20 in the first embodiment. The test state setting circuit 30 contains a positive test double-bit display data generating circuit 32 and a negative test double-bit display data generating circuit 33. The respective generating circuits 32 and 33 generate the 4-bit double-bit display data (D2, D2B, D1 and D1B) from the 2-bit display data (D2, D1) when the test signal is turned off. Here, when Dk="H", DkB="L", and when Dk="L", DkB="H" (K=1, 2). Also, the respective generating circuits 32 and 33 generate the 4-bit test double-bit display data (D21, D22, D11 and D12) from the 2-bit display data (D2, D1), when the test signal is turned on. A D/A converter circuit 31 selects a desirable gradation voltage from the four gradation voltages in accordance with the 4-bit double-bit display data. As described later, a test switch TESTSW2 is provided in a positive gradation voltage generating circuit 34 in the D/A converter circuit 31, and a test switch TESTSW3 is provided in a negative gradation voltage generating circuit 35.

Figure 10:
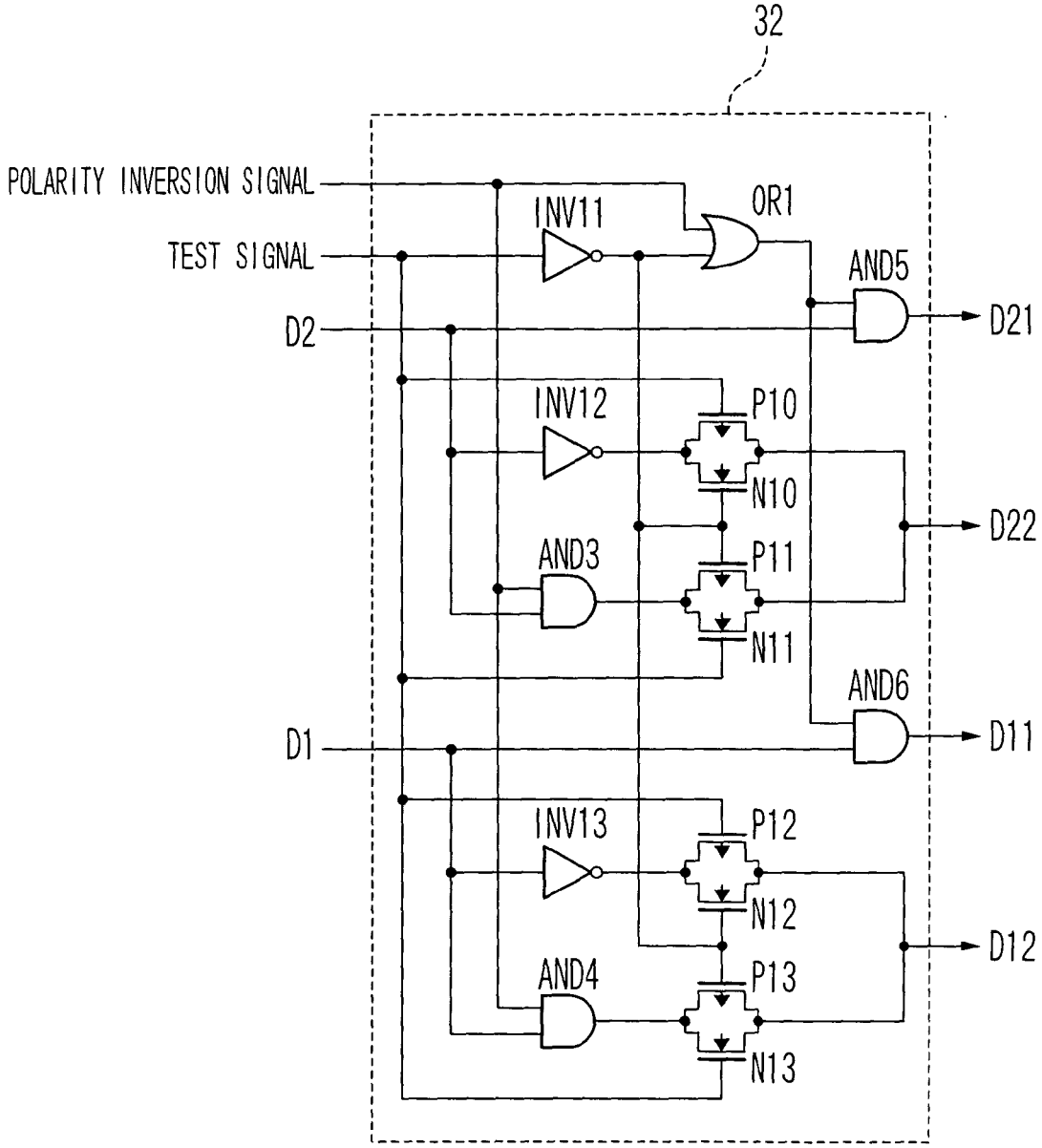
FIG. 10 is a circuit diagram showing the configuration of a positive test double-bit display data generating circuit.

The test state setting circuit 30 will be described below with reference to FIGS. 10 and 11. FIG. 10 is a circuit diagram showing the configuration of the positive test double-bit display data generating circuit 32. At first, the operation of the positive test double-bit display data generating circuit 32 when the test signal is turned off will be described. When the test signal is turned off, the output of an inverter INV11 becomes high, and the output of an OR circuit OR1 becomes high. Thus, one input of an AND circuit AND5 becomes high. Also, the data D2 that is the other input of the AND circuit AND5 is outputted as the output D21. Also, since the output of the inverter INV11 is high and transistors P10 and N10 are turned on, the data D2 is inverted by an INV12, and the data D2B is outputted as the data D22 through the transistors P10 and N10. Also, since the output of the inverter INV11 is high, the output of the OR circuit OR1 becomes high and one input of an AND circuit AND6 becomes high. Thus, the data D1 that is the other input of the AND circuit AND6 is outputted as the data D11. Also, the output of the inverter INV11 is high and transistors P12 and N12 are turned on. Thus, the data D1 is inverted by an inverter INV13. Then, the data D1B is outputted as the data D12 through the transistors P12 and N12. That is, D21=D2, D22=D2B, D11=D1 and D12=D1B.

Next, the operation of the positive test double-bit display data generating circuit 32 when the test signal is turned on will be described. When the polarity inversion signal is turned off, the output of the inverter INV11 becomes low, the output of the OR circuit OR1 becomes low, and the output of the AND circuit AND5 becomes low. Thus, D21="L". Also, the output of the inverter INV11 is low, the transistors P10 and N10 are turned off, the transistors P11 and N11 are turned on, and the output of the AND circuit AND3 receiving the polarity inversion signal becomes low. Thus, D22="L". Also, the output of the inverter INV11 is low, the output of the OR circuit OR1 is low, and the output of the AND circuit AND6 becomes low. Thus, D11="L". Also, the output of the inverter INV11 is low, the transistors P12 and N12 are turned off, the transistors P13 and N13 are turned on, and the output of the AND circuit AND4 receiving the polarity inversion signal becomes low. Thus, D12="L". That is, D21=D22=D11=D12="L".

When the polarity inversion signal is turned on, the output of the OR circuit OR1 becomes high, and one input of the AND circuit AND5 is high. Thus, D21=D2. Also, the output of the inverter INV11 is low, the transistors P10 and N10 are tuned off, the transistors P11 and N11 are turned on, and one input of the AND circuit AND3 is high. Thus, D22=D2. Also, since the output of the OR circuit OR1 is high and one input of the AND circuit AND6 is high, D11=D1. Also, the output of the inverter INV11 is low, the transistors P12 and N12 are turned off, the transistors P13 and N13 are turned on, and one input of the AND circuit AND4 is high. Thus, D12=D1. That is, D21=D22=D2 and D11=D12=D1.

As mentioned above, the positive test double-bit display data generating circuit 32 outputs D21=D2, D22=D2B, D11=D1 and D12=D1B when the test signal is turned off, and outputs D21=D22=D11=D12="L" when the test signal is turned on and the polarity inversion signal is turned off, and outputs D21=D22=D2 and D11=D12=D1 when both of the test signal and the polarity inversion signal are turned on.

Figure 11:
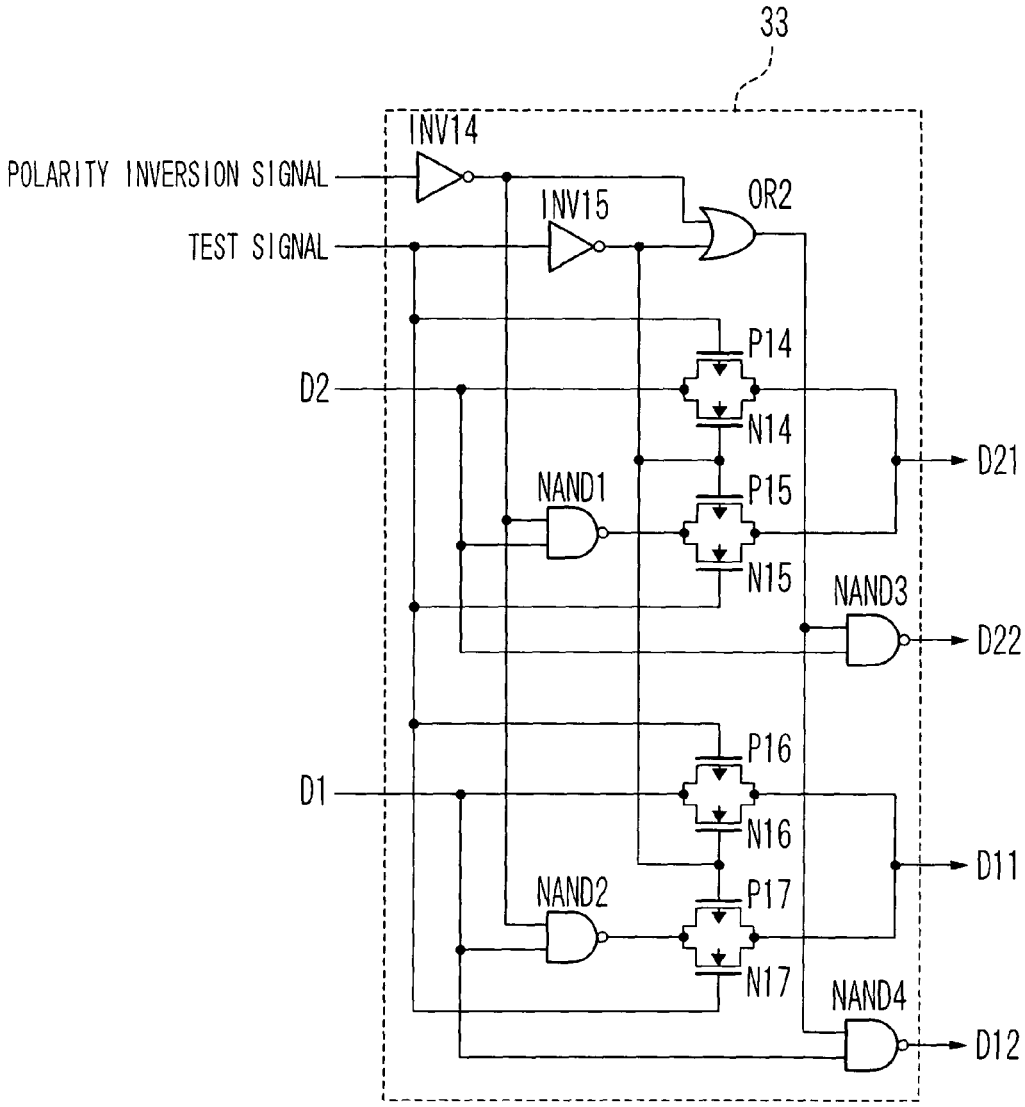
FIG. 11 is a circuit diagram showing the configuration of a negative test double-bit display data generating circuit.

FIG. 11 is a circuit diagram showing the configuration of the negative test double-bit display data generating circuit 33. At first, the operation of the negative test double-bit display data generating circuit 33 when the test signal is turned off will be described. When the test signal is turned off, the output of an inverter INV15 becomes high, transistors P14 and N14 are turned on and transistors P15 and N15 are turned off. Thus, D21=D2. Also, the output of the inverter INV15 is high, the output of the OR circuit OR2 becomes high and one input of an NAND circuit NAND3 becomes high. Thus, D22=D2B. Also, the output of the inverter INV15 is high, transistors P16 and N16 are turned on and transistors P17 and N17 are turned off. Thus, D11=D1. Also, the output of the inverter INV15 is high, the output of the OR circuit OR2 is high and one input of a NAND circuit NAND4 becomes high. Thus, D12=D1B. That is, D21=D2, D22=D2B, D11=D1 and D12=D1B.

Next, the operation of the negative test double-bit display data generating circuit 33 when the test signal is turned on will be described. When the polarity inversion signal is turned off, the output of the inverter INV15 becomes low, the transistors P14 and N14 are turned off, the transistors P15 and N15 are turned on, the output of the inverter INV14 is high and one input of a NAND circuit NAND1 is turned on. Thus, D21=D2B. Also, the output of the inverter INV14 is high, the output of the OR circuit OR2 is high and one input of the NAND circuit NAND3 is high. Thus, D22=D2B. Also, the output of the inverter INV15 is low, the transistors P16 and N16 are turned off, the transistors P17 and N17 are turned on, the output of the inverter INV14 is high and one input of the NAND circuit NAND2 becomes high. Thus, D11=D1B. Also, the output of the inverter INV14 is high, the OR circuit OR2 is high and one input of the NAND circuit NAND4 becomes high. Thus, D12=D1B. That is, D21=D2B, D22=D2B, D11=D1B and D12=D1B.

When the polarity inversion signal is turned on, the output of the inverter INV15 becomes low, the transistors P14 and N14 are turned off, the transistors P15 and N15 are turned on, the output of the inverter INV14 is low and one input of the NAND circuit NAND1 is low. Thus, D21="H". Also, the output of the inverter INV14 is low, the output of the inverter INV15 is low, the output of the OR circuit OR2 is low and one input of the NAND circuit NAND3 is low. Thus, D22="H". Also, the output of the inverter INV15 is low, the transistors P16 and N16 are turned off, the transistors P17 and N17 are turned on, the output of the inverter INV14 is low and one input of the NAND circuit NAND2 is low. Thus, D11="H". Also, the output of the inverter INV14 is low, the output of the inverter INV15 is low, the output of the OR circuit OR2 is low and one input of the NAND circuit NAND4 is low. Thus, D12="H". That is, D21=D22=D11=D12="H".

As mentioned above, the negative test double-bit display data generating circuit 33 outputs D21=D2, D22=D2B, D11=D1 and D12=D1B when the test signal is turned off, and outputs D21=D2B, D22=D2B, D11=D1B and D12=D1B when the test signal is turned on and the polarity inversion signal is turned off, and outputs D21=D22=D11=D12="H" when both of the test signal and the polarity inversion signal are turned on.

Figure 12:
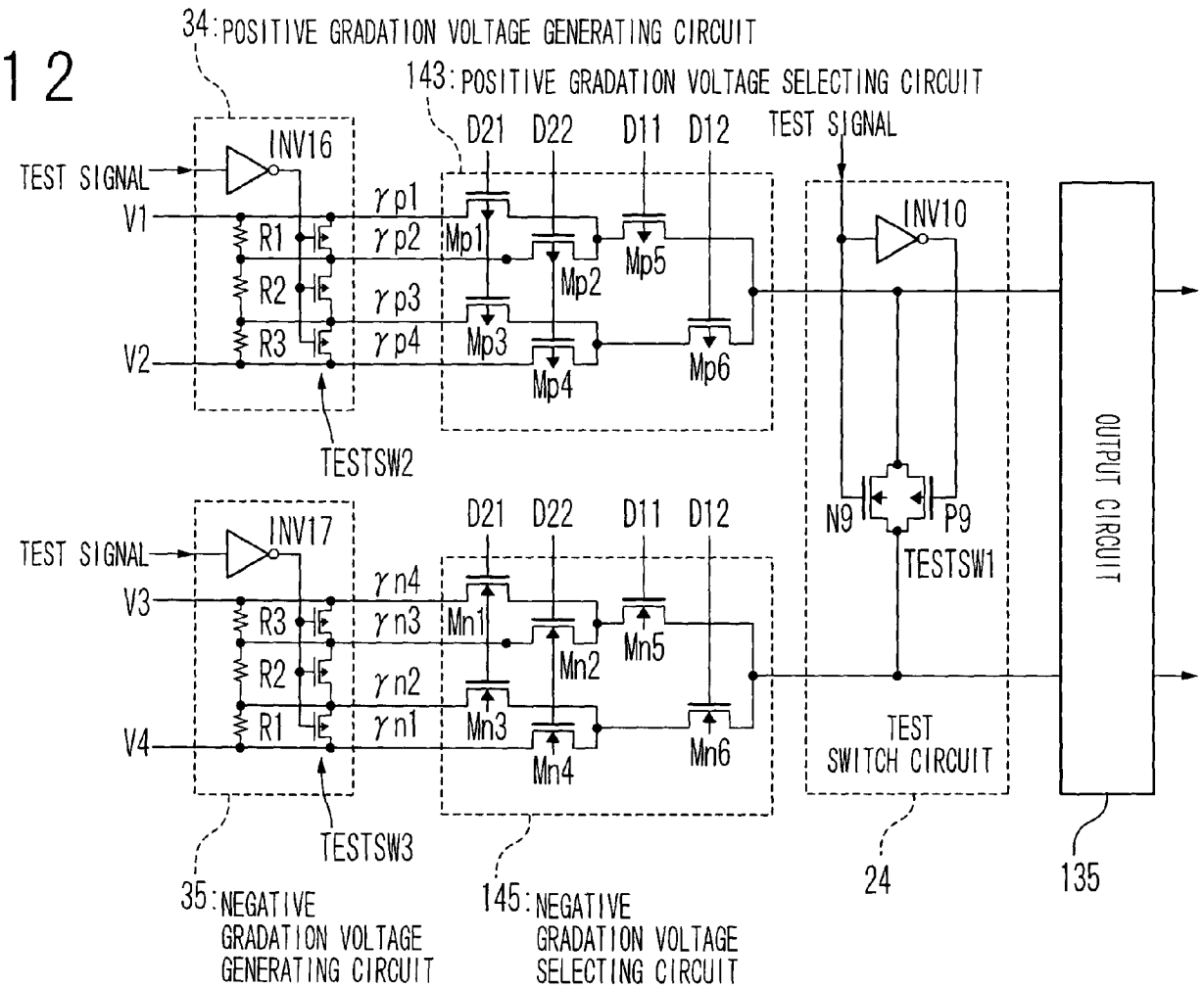
FIG. 12 is a block diagram showing a D/A converter circuit.

Next, the D/A converter circuit 31 will be described with reference to FIG. 12. In FIG. 12, the D/A converter circuit 31 contains a positive gradation voltage generating circuit 34, the positive gradation voltage selecting circuit 143, a negative gradation voltage generating circuit 35, the negative gradation voltage selecting circuit 145 and the test switching circuit 24. The positive gradation voltage generating circuit 34 has ladder resistors R1, R2 and R3. When the test signal is in the off state, the positive gradation voltage generating circuit 34 receives gradation reference voltages V1 and V2 (V1>V2) and supplies the positive gradation voltages γp1 to γp4 of the 4 ($=2^2$) gradation levels. Also, when the test signal is in the on state, the positive gradation voltage generating circuit 34 receives the test voltage VTESTVP to at least one of the terminals V1 and V2 and supplies the test voltage VTESTVP from the output ends of the positive gradation voltages γp1 to γp4 of the 4 ($=2^2$) gradation levels. At this time, since the output of the inverter INV16 is low, the test switch TESTSW2 is turned on. Thus, the positive gradation voltage generating circuit 34 supplies the test voltage VTESTVP from all of the output ends of the positive gradation voltages γp1 to γp4 without any intervention of the ladder resistors R1, R2 and R3. The negative gradation voltage generating circuit 35 has ladder resistors R3, R2 and R1. When the test signal is in the off state, the negative gradation voltage generating circuit 35 receives gradation reference voltages V3 and V4 (V3>V4) and supplies the negative gradation voltages γn4 to γn1 of 4 ($=2^2$) gradation levels. Also, when the test signal is in the on state, the negative gradation voltage generating circuit 35 receives the test voltage VTESTVN to at least one of the terminals V3 and V4 and supplies the test voltage VTESTVN from the output ends of the negative gradation voltages γn1 to γn4. At this time, since the output of the inverter INV17 is low, the test switch TESTSW3 is turned on. Thus, the negative gradation voltage generating circuit 35 supplies the test voltage VTESTVN from all of the output ends of the negative gradation voltages γn1 to γn4 without any intervention of the ladder resistors R1, R2 and R3.

Figure 1:
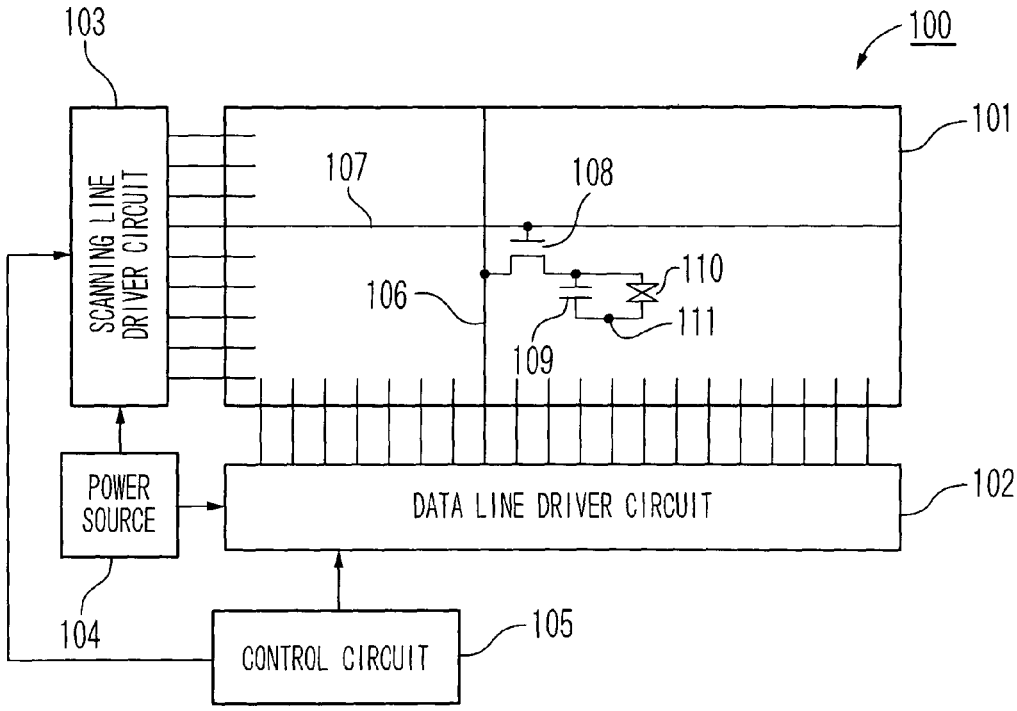
Fig. 1 RELATED ART
FIG. 1 is a block diagram showing a liquid crystal display apparatus.
Figure 2:
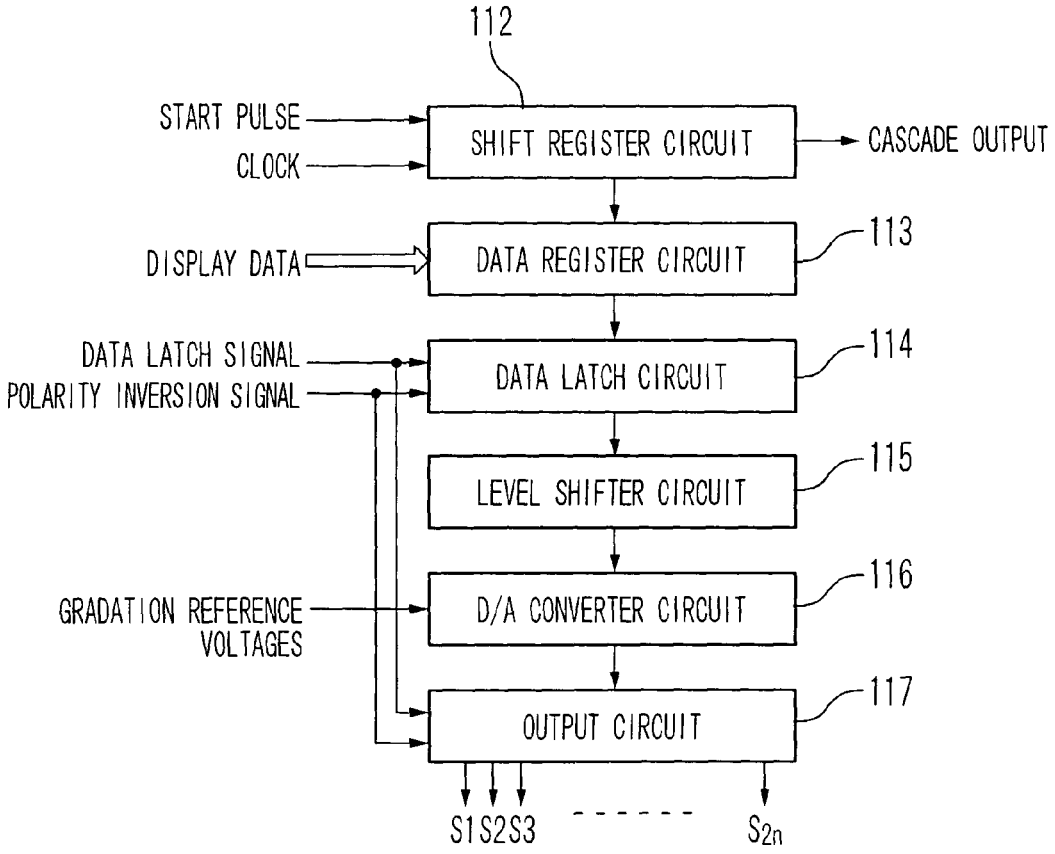
Fig. 2 RELATED ART
FIG. 2 is a block diagram showing a data line driver circuit used in a dot inversion method.
Figure 3:
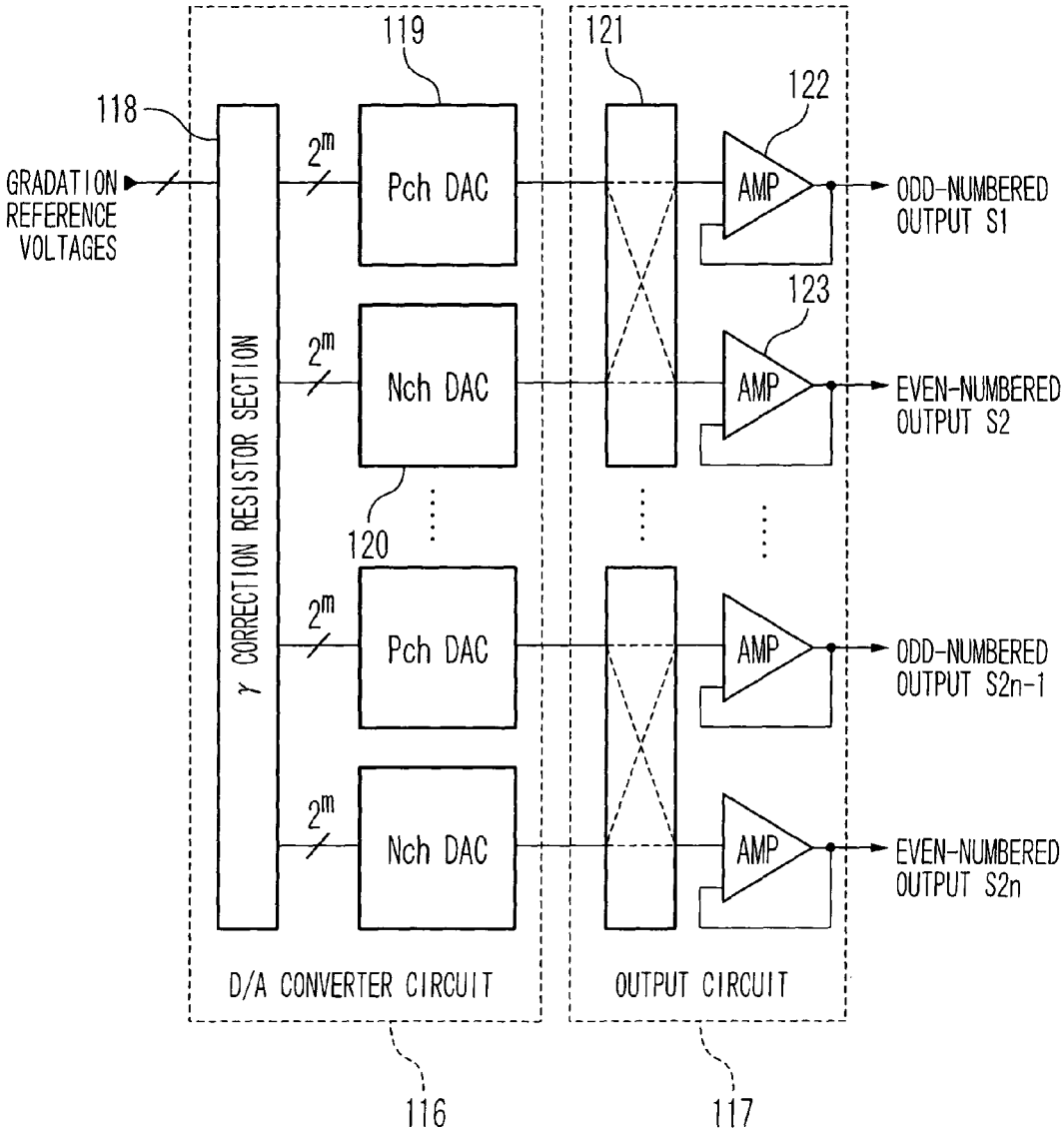
Fig. 3 RELATED ART
FIG. 3 is a block diagram showing a D/A converter circuit.

The operation of the D/A converter circuit 31 when the test signal is in the off state is similar to the operation of the D/A converter circuit 21 in FIG. 2. Thus, the description of the operation is omitted.

The operation of the D/A converter circuit 31 when the test signal is in the on state will be described. Similarly to the first embodiment, the test voltage VTESTVP is supplied to the positive gradation voltage generating circuit 34, and the test voltage VTESTVN is supplied to the negative gradation voltage generating circuit 35. At this time, in the test switching circuit 24, since the test switch TESTSW1 is turned on, the gradation voltage signal line for transferring the positive gradation voltage selected by the positive gradation voltage selecting circuit 143 and the gradation voltage signal line for transferring the negative gradation voltage selected by the negative gradation voltage selecting circuit 145 are electrically short-circuited. Also, the test switches TESTSW2 and TESTSW3 are turned on. Thus, the test voltage VTESTVP is supplied to the positive gradation voltage selecting circuit 143 from all of the output ends of the positive gradation voltages γp1 to γp4 of the positive gradation voltage generating circuit 34 without any intervention of the ladder resistors R1, R2 and R3. The test voltage VTESTVN is supplied to the negative gradation voltage selecting circuit 145 from all of the output ends of the negative gradation voltages γn1 to γn4 of the negative gradation voltage generating circuit 35 without any intervention of the ladder resistors R1, R2 and R3.

The operation when the polarity inversion signal is turned off will be described. At this time, the test state setting circuit 30 outputted D21=D22=D11=D12="L" as the positive test double-bit display data. On the other hand, the test state setting circuit 30 outputted D21=D2B, D22=D2B, D11=D1B and D12=D1B as the negative test double-bit display data. Also, the double-bit display data generated in accordance with the first display data appeared an the positive double-bit display data, and the double-bit display data generated in accordance with the second display data appeared as the negative double-bit display data. In this example, the test is carried out under the assumption of the first display data (D2, D1)=the second display data (D2, D1) at the time of the test.

The leakage current between the drain and the source in each of the transistors Mn1 to Mn4 is tested. The first display data (D2, D1)=the second display data (D2, D1)=(H, L) is supplied to the data line driver circuit. In the positive gradation voltage selecting circuit 143, (D21, D22, D11, D12)=(L, L, L, L) is received as the positive test double-bit display data. Thus, the transistors Mp1 to Mp6 are turned on. As a result, all of the routes through which the gradation voltages γp1 to γp4 are outputted in the usual state are selected. Therefore, the test voltage VTESTVP is applied through all of the selected routes and the test switching circuit 24 to the gradation voltage signal line for transferring the negative gradation voltage selected by the negative gradation voltage selecting circuit 145. In the negative gradation voltage selecting circuit 145, (D21, D22, D11, D12)=(L, L, H, H) is received as the negative test double-bit display data. Thus, the transistors Mn5 and Mn6 are turned on, and the transistors Mn1, Mn2, Mn3 and Mn4 are turned off. As a result, the test voltage VTESTVP through the transistors Mn5 and Mn6 and the test voltage VTESTVN through the negative gradation voltage generating circuit 35 are applied between the drain and the source in each of the transistors Mn1 to Mn4. By measuring the current values at this time, it is possible to test the leakage current between the drain and the source in each of the transistors Mn1 to Mn4. In this example, the test voltage is supplied between the drain and the source in each of the transistors Mn1 to Mn4 through all of the routes in the positive gradation voltage selecting circuit 143 without any intervention of the ladder resistors R3, R2 and R1 in the positive gradation voltage generating circuit 34 and the negative gradation voltage generating circuit 35. Therefore, it is possible to carry out the leakage current test whose precision is higher than the case of the first embodiment.

The leakage current between the drain and the source in each of the transistors Mn5 and Mn6 is tested. The first display data (D2, D1)=the second display data (D2, D1)=(L, H) is supplied to the data line driver circuit. Similarly to the case of testing the leakage current between the drain and the source in each of the transistors Mn1 to Mn4, the test voltage VTESTVP is applied to the gradation voltage signal line for transferring the negative gradation voltage selected by the negative gradation voltage selecting circuit 145. In the negative gradation voltage selecting circuit 145, (D21, D22, D11, D12)=(H, H, L, L) is received as the negative test double-bit display data. Thus, the transistors Mn1, Mn2, Mn3 and Mn4 are turned on, and the transistors Mn5 and Mn6 are turned off. As a result, the test voltage VTESTVP and the test voltage VTESTVN through the negative gradation voltage generating circuit 35 and the transistors Mn1 to Mn4 are applied between the drain and the source in each of the transistors Mn5 and Mn6. By measuring the current values at this time, it is possible to test the leakage current between the drain and the source in each of the transistors Mn5 and Mn6. In this example, the test voltage is supplied between the drain and the source in each of the transistors Mn5 and Mn6 through all of the routes in the positive gradation voltage selecting circuit 143 without any intervention of the ladder resistors R3, R2 and R1 in the positive gradation voltage generating circuit 34 and the negative gradation voltage generating circuit 35. Thus, it is possible to carry out the leakage current test whose precision is higher than the case of the first embodiment The operation when the polarity inversion signal is turned on will be described. At this time, the test state setting circuit 30 outputted D21=D22=D2 and D11=D12=D1 as the positive test double-bit display data. On the other hand, the test state setting circuit 30 outputted D21=D22=D11=D12="H" as the negative test double-bit display data. Also, the double-bit display data generated in accordance with the second display data appeared as the positive double-bit display data, and the double-bit display data generated in accordance with the first display data appeared as the negative double-bit display data. Also, in this example, similarly to the case when the polarity inversion signal is turned off, the test is carried out under the assumption of the first display data (D2, D1)=the second display data (D2, D1) at the time of the test.

The leakage current between the drain and the source in the transistors Mp1 to Mp4 is tested. The first display data (D2, D1)=the second display data (D2, D1)=(H, L) is supplied to the data line driver circuit. In the negative gradation voltage selecting circuit 145, (D21, D22, D11, D12)=(H, H, H, H) is received as the negative test double-bit display data. Thus, the transistors Mn1 to Mn6 are turned on. As a result, all of the routes through which the gradation voltages γn1 to γn4 are outputted in the usual state are selected. Therefore, the test voltage VTESTVN is applied through the selected routes and the test switching circuit 24 to the gradation voltage signal line for transferring the positive gradation voltage selected by the positive gradation voltage selecting circuit 143. In the positive gradation voltage selecting circuit 143, (D21, D22, D11, D12)=(H, H, L, L) is supplied as the positive test double-bit display data. Thus, the transistors Mp5 and Mp6 are turned on, and the transistors Mp1, Mp2, Mp3 and Mp4 are turned off. As a result, the test voltage VTESTVP through the positive gradation voltage generating circuit 34 and the test voltage VTESTVN through the transistors Mp5 and Mp6 are applied between the drain and the source in each of the transistors Mp1 to Mp4. By measuring the current values at this time, it is possible to test the leakage current between the drain and the source in each of the transistors Mp1 to Mp4. In this example, the test voltage is supplied between the drain and the source in each of the transistors Mp1 to Mp4 through all of the routes in the negative gradation voltage selecting circuit 145 without any intervention of the ladder resistors R3, R2 and R1 in the positive gradation voltage generating circuit 34 and the negative gradation voltage generating circuit 35. Therefore, it is possible to carry out the leakage current test whose precision is higher than the case of the first embodiment.

The leakage current between the drain and the source in each of the transistors Mp5 and Mp6 is tested. The first display data (D2, D1)=the second display data (D2, D1)=(L, H) is supplied to the data line driver circuit. Similarly to the case of testing the leakage currents between the DS in the transistors Mp1 to Mp4, the test voltage VTESTVN is applied to the gradation voltage signal line for transferring the positive gradation voltage selected by the positive gradation voltage selecting circuit 143. In the positive gradation voltage selecting circuit 143, (D21, D22, D11, D12)=(L, L, H, H) is supplied as the positive test double-bit display data. Thus, the transistors Mp1, Mp2, Mp3 and Mp4 are turned on, and the transistors Mp5 and Mp6 are turned off. As a result, the test voltage VTESTVN and the test voltage VTESTVP through the positive gradation voltage generating circuit 34 and the transistors Mp1 to Mp4 are applied between the drain and the source in each of the transistors Mp5 and Mp6. By measuring the current values at this time, it is possible to test the leakage current between the drain and the source in each of the transistors Mp5 and Mp6. In this example, the test voltage is supplied between the drain and the source in each of the transistors Mp5 and Mp6 through all of the routes in the negative gradation voltage selecting circuit 145 without any intervention of the ladder resistors R3, R2 and R1 in the positive gradation voltage generating circuit 34 and the negative gradation voltage generating circuit 35. Thus, it is possible to carry out the leakage current test whose precision is higher than the case of the first embodiment.

Although the present invention has been described above in connection with several embodiments thereof, it will be appreciated by those skilled in the art that those embodiments are provided solely for illustrating the present invention, and should not be relied upon to construe the appended claims in a limiting sense.

What is claimed is:

1. A data line driver circuit for a display panel comprising:

a digital-to-analog (D/A) converter circuit configured to convert two display data to be supplied into gradation voltages of first and second polarities, wherein said D/A converter circuit comprises:

a first gradation voltage selecting circuit configured to control transistors of a first group to select one of gradation voltages of the first polarity based on a first display data of the two display data;

a second gradation voltage selecting circuit configured to control transistors of a second group to select one of gradation voltages of the second polarity based on a second display data of the two display data;

a first gradation voltage signal line configured to transfer the first polarity gradation voltage selected by said first gradation voltage selecting circuit;

a second gradation voltage signal line configured to transfer the second polarity gradation voltage selected by said second gradation voltage selecting circuit; and a test switching circuit configured to operate in response to a test signal, wherein said test switching circuit forms a short-circuit between said first and second gradation voltage signal lines in response to the test signal, to allow a leakage current to be measured between a drain and a source in each of one or more of said transistors of said first group and one or more of said transistors of said second group.

2. The data line driver circuit according to claim 1, further comprising:

a first test display data generating circuit configured to generate a first test display data in response to the test signal; and a second test display data generating circuit configured to generate a second test display data in response to the test signal, wherein said first gradation voltage selecting circuit receives the first test display data and controls said transistors of said first group, and said second gradation voltage selecting circuit receives the second test display data and controls said transistors of said second group.

3. The data line driver circuit according to claim 2, wherein said first test display data generating circuit generates the first test display data based on a predetermined logic in response to the test signal, and said second test display data generating circuit generates the second test display data based on a predetermined logic in response to the test signal.

4. The data line driver circuit according to claim 2, wherein when the first display data is of m bits, said first gradation voltage selecting circuit controls said transistors of said first group, such that all of said one or more transistors of said first group are turned off based on a logic level of one bit of the m bits, and all of said one or more transistors of said first group are turned on based on a logic level of each bit of the remaining (m−1) bits.

5. The data line driver circuit according to claim 1, further comprising:

a first gradation voltage generating circuit configured to generate said first polarity gradation voltages from first reference voltages and to supply to said first gradation voltage selecting circuit; and a second gradation voltage generating circuit configured to generate said second polarity gradation voltages from second reference voltages to supply to said second gradation voltage selecting circuit, said first gradation voltage generating circuit supplies a test voltage of the first polarity to at least one of input terminals of the first reference voltages in response to the test signal, and said second gradation voltage generating circuit supplies a test voltage of the second polarity to at least one of input terminals of the second reference voltages in response to the test signal.

6. The data line driver circuit according to claim 5, wherein said first gradation voltage generating circuit comprises a first test switch configured to operate in response to the test signal, said first test switch forms a short-circuit between signal lines, which transfer said first polarity gradation voltages supplied from said first gradation voltage generating circuit, in response to the test signal, said second gradation voltage generating circuit comprises a second test switch configured to operate in response to the test signal, and said second test switch forms a short-circuit between signal lines, which transfer said second polarity gradation voltages supplied from said second gradation voltage generating circuit, in response to the test signal.

7. A test method for a data line driver circuit for a display panel, said test method comprising:

providing a digital-to-analog (D/A) converter circuit configured to convert two display data to be supplied into gradation voltages of first and second polarities, wherein said D/A converter circuit comprises a first gradation voltage selecting circuit configured to select one of gradation voltages of the first polarity based on a first display data; and a second gradation voltage selecting circuit configured to select one of gradation voltages of the second polarity based on a second display data;

supplying a test voltage of the first polarity to said first gradation voltage selecting circuit and a test voltage of the second polarity to said second gradation voltage selecting circuit; and measuring a leakage current between an input and an output in one of said first and second gradation voltage selecting circuits by using the other of said first and second gradation voltage selecting circuits in response to a test signal.

8. The test method according to claim 7, wherein said measuring comprises:

generating first and second test display data in response to the test signal; and controlling said first and second gradation voltage generating circuits based on the first and second test display data.

9. The test method according to claim 8, wherein said measuring further comprises:

short-circuiting outputs of said first and second gradation voltage selecting circuits in response to the test signal.

10. The test method according to claim 9, wherein said measuring further comprises:

turning on at least one of transistors in one of a first group of said first gradation voltage selecting circuit and said second group of said second gradation voltage selecting circuit; and turning off remaining ones of said transistors of the other group in response to the test signal.

11. The test method according to claim 10, wherein said measuring comprises:

controlling said transistors of said first and second groups based on first and second double-bit display data of double bits having opposite logic levels in response to the test signal; and controlling said transistors of said first and second groups based on the first and second double-bit display data of double bits having a same logic level in response to the test signal.

12. A display apparatus, comprising:

a display panel; and a data line driver circuit comprising a digital-to-analog (D/A) converter circuit configured to convert two display data to be supplied into gradation voltages of first and second polarities, wherein said D/A converter circuit comprises:

a first gradation voltage selecting circuit configured to control transistors of a first group to select one of gradation voltages of the first polarity, based on a first display data of the two display data;

a second gradation voltage selecting circuit configured to control transistors of a second group to select one of gradation voltages of the second polarity, based on a second display data of the two display data;

a first gradation voltage signal line'configured to transfer the first polarity gradation voltage selected by said first gradation voltage selecting circuit;

a second gradation voltage signal line configured to transfer the second polarity gradation voltage selected by said second gradation voltage selecting circuit; and a test switching circuit configured to operate in response to a test signal, wherein said test switching circuit forms a short-circuit between said first and second gradation voltage signal lines in response to the test signal, to allow a leakage current to be measured between a drain and a source in each of one or more of said transistors of said first group and one or more of said transistors of said second group.

13. The display apparatus according to claim 12, further comprising:

a first test display data generating circuit configured to generate a first test display data in response to the test signal; and a second test display data generating circuit configured to generate a second test display data in response to the test signal, wherein said first gradation voltage selecting circuit receives the first test display data and controls said transistors of said first group, and said second gradation voltage selecting circuit receives the second test display data and controls said transistors of said second group.

14. The display apparatus according to claim 13, wherein said first test display data generating circuit generates the first test display data based on a predetermined logic in response to the test signal, and said second test display data generating circuit generates the second test display data based on a predetermined logic in response to the test signal.

15. The display apparatus according to claim 13, wherein when the first display data is of m bits, said first gradation voltage selecting circuit controls said transistors of said first group, such that all of said one or more transistors of said first group are turned off based on a logic level of one bit of the m bits, and all of said one or more transistors of said first group are turned on based on a logic level of each bit of the remaining (m−1) bits.

16. The display apparatus according to claim 12, further comprising:

a first gradation voltage generating circuit configured to generate said first polarity gradation voltages from first reference voltages and to supply to said first gradation voltage selecting circuit; and a second gradation voltage generating circuit configured to generate said second polarity gradation voltages from second reference voltages to supply to said second gradation voltage selecting circuit, said first gradation voltage generating circuit supplies a test voltage of the first polarity to at least one of input terminals of the first reference voltages in response to the test signal, and said second gradation voltage generating circuit supplies a test voltage of the second polarity to at least one of input terminals of the second reference voltages in response to the test signal.

17. The display apparatus according to claim 16, wherein said first gradation voltage generating circuit comprises a first test switch configured to operate in response to the test signal, said first test switch forms a short-circuit between signal lines, which transfer said first polarity gradation voltages supplied from said first gradation voltage generating circuit, in response to the test signal, said second gradation voltage generating circuit comprises a second test switch configured to operate in response to the test signal, and said second test switch forms a short-circuit between signal lines, which transfer said second polarity gradation voltages supplied from said second gradation voltage generating circuit, in response to the test signal.

* * * * *